US005245762A

United States Patent [19]

Hartis et al.

[11] Patent Number: 5,245,762

[45] Date of Patent: Sep. 21, 1993

[54] SLUDGE DRYING APPARATUS AND METHOD

[76] Inventors: Dennis R. Hartis, 116 Longwood Dr., Spartanburg, S.C. 29301; Thomas W. Hartis, 2501 Stilwell Rd., Matthews, S.C. 28105

[21] Appl. No.: 934,784

[22] Filed: Aug. 24, 1992

[51] Int. Cl.[5] ..... F26B 5/04

[52] U.S. Cl. ..... 34/15; 34/102; 34/92

[58] Field of Search ..... 34/179, 180, 181, 182, 34/183, 92, 60, 69, 218, 203, 17, 28, 33, 56, 15, 102; 432/215

[56] References Cited

U.S. PATENT DOCUMENTS

| | | | |
|---|---|---|---|
| 605,025 | 5/1898 | Spencer | 34/102 |
| 4,051,603 | 10/1977 | Kern, Jr. | 34/57 A |
| 4,745,691 | 5/1988 | Bradbury | 34/180 X |
| 4,852,269 | 8/1989 | Glonioso | 34/11 |
| 4,913,771 | 4/1990 | McIntyre | 34/92 X |
| 5,069,801 | 12/1991 | Girovich | 210/770 |

*Primary Examiner*—Henry A. Bennet

*Attorney, Agent, or Firm*—Dority & Manning

[57] ABSTRACT

A treating apparatus for drying wet sludge in batches or continuous feed which is circulated through the apparatus. The apparatus includes conveyor means for circulating the wet sludge in a closed loop and means for heating and circulating the dryer air around and about the conveyor means without contacting the sludge itself. It also includes means for heating and circulating cleaning air through the sludge to dry the sludge as it is circulating in the closed loop. A sensor is provided for determining the moisture content of the sludge and means are provided for discharging the sludge from the conveyor circulating means when the moisture content in the sludge reaches a predetermined level. A measured amount of cleaning air is drawn into the conveyor means from the atmosphere and circulates through the sludge itself to assist in drying and cleaning the sludge. This air is then withdrawn from the interior of the conveying means and exhausted through a cleaning means into the atmosphere. The invention includes a method of operating the apparatus to dry wet sludge.

17 Claims, 7 Drawing Sheets

SLUDGE DRYING APPARATUS AND METHOD

BACKGROUND OF THE INVENTION

The present invention relates to an apparatus and process for drying wet sludge, particularly industrial waste sludge. The sludge is circulated through the apparatus as it is being dried.

Municipal waste water treatment plants create sewage sludge in large amounts. Also, industrial sludge of any variety is becoming a sensitive environmental concern. Raw sewage received in waste water treatment facilities is treated by various known methods which generate the wet sludge. Industrial sludge is generated from any variety of industrial processes. Thereafter, a problem remains as to how to treat the wet sludge in an environmentally safe, energy efficient, and economical manner. In the past, such sludge has been disposed in many ways such as direct land application of the sludge, composting the sludge, land filling the sludge, ocean filling the sludge, and drying and incinerating the sludge. Wet sludge typically contains inorganic and organic matter, nutrients such as nitrogen, phosphorous, potassium, and traces of various other metals. The sludge may also contain heavy metals and hazardous organics, depending upon the source of the raw sewage or industrial waste that has been treated.

In known methods of treating wet sludge, the sludge is treated to increase the solid content thereof. That is, the sludge is dewatered by gravity, by mechanically dewatering the sludge, or by thermal treatment of the sludge.

SUMMARY OF THE INVENTION

An object of the present invention is to provide a simple batch or continuous treating apparatus for dying wet sludge in batches which are circulated through the apparatus.

It is another object of the present invention to provide an economical and environmentally safe process for treating wet sludge.

Still a further object of the present invention is to provide an apparatus and method for treating a relatively large volume of sludge in a relatively short period of time in an economical manner.

The sludge drying apparatus according to the invention comprises a housing structure and a hopper or loading device which provides internal access to the housing structure for receiving a batch of sludge. Conveyor means are provided substantially internal to the housing structure for receiving the sludge from the hopper. The conveyor means comprises essentially a closed loop circulating path for the sludge within the housing structure. Means are provided for drawing a vacuum of predetermined magnitude within the conveyor means, and means are also provided for heating and circulating housing drying air around the conveyor means within the housing structure. Means are further provided for heating and drawing sludge drying air through the conveyor means so as to directly contact and dry the sludge as the heated air circulates within the closed loop. Means are further provided for discharging the sludge from the conveyor means once the sludge has been dried to a predetermined moisture content.

Preferably the sludge drying apparatus comprises a plurality of augers within respective auger housings, the augers and auger housings configured in an essentially continuous loop whereby at least one of the augers has an opening for receiving a volume of sludge and the same or another auger has an opening for discharging the sludge.

In yet another preferred embodiment of the invention, the apparatus includes a sensing device, such as a humidistat, for sensing the moisture content of the sludge within the conveyor means.

Preferably, the apparatus of the present invention also includes air cleaning and filtering means, such as a wet scrubber and cyclone separator for cleaning the sludge drying air which has been drawn through the conveyor prior to the air being exhausted to atmosphere. Also, preferably means are provided, such as a damper, for drawing a controlled amount of fresh air into the conveyor means.

In a preferred embodiment, the means for heating and circulating the housing drying air comprises essentially a recirculating airstream which includes a blower for circulating air, and a heating device for heating the circulated air. The recirculating airstream path includes the space within the housing structure and around the conveyor means. The heated air drawn through the conveyor means (sludge drying air) is preferably heated through conduction by the heated housing drying air. For example, preferably a portion of the sludge drying air piping system runs through the housing drying piping system downstream from the heating device so that the heated housing drying air can heat the sludge drying air.

In still another preferred embodiment of the invention, the conveyor means according to the invention comprises a plurality of augers and respective auger housings, for example, four augers and associated housings. The augers and associated housings are arranged so that a first auger moves sludge along substantially the entire length thereof and discharges the sludge into a second auger. The second auger moves the sludge through substantially the entire length thereof and discharges the sludge into a third auger, and so forth. In this manner, the plurality of augers forms a continuous recirculating loop for the sludge.

In still further accordance with the present invention, a method is provided for drying wet sludge. The method comprises the steps of feeding a batch of wet sludge into a multi-pass dryer conveyor means and circulating the wet sludge through the conveyor means. The method further calls for drawing a vacuum within the dryer conveyor means and drawing heated sludge drying air through the conveyor means and sludge as the sludge circulates through the conveyor means. The method further includes drawing heated drying air around the conveyor means separate from the sludge drying air to remove moisture from the space around the conveyor means. The moisture content of the sludge being circulated through the conveyor means is sensed and indicated. The method further calls for cleaning the sludge drying air before exhausting the air to atmosphere with, for example, a wet scrubber or cyclone separator. Finally, the sludge is removed from the conveyor means once it has dried to a sufficient moisture content.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The accompanying drawings, which are incorporated in and constitute a part of the specification, illustrate one embodiment of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

DETAILED DESCRIPTION OF THE INVENTION

Figure 1:
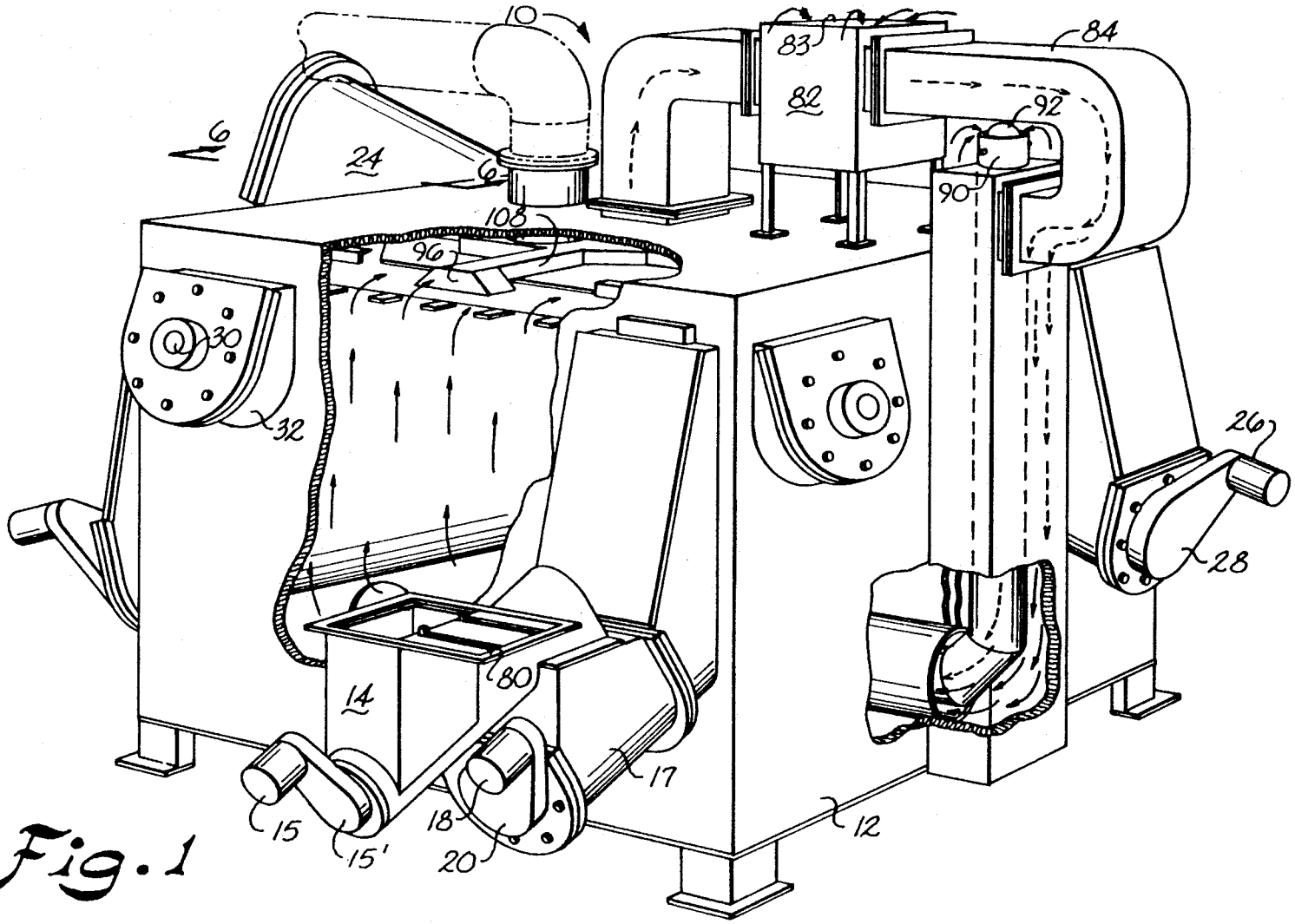
FIG. 1 is a perspective view of the apparatus of the invention with portions shown in partial cut-away.

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. The numbering of components in the drawings is consistent throughout the application, with the same components having the same number in each of the drawings.

Referring to the claims in general, apparatus 10 according to the invention comprises housing structure 12. Structure 12 is essentially a pneumatically closed or sealed structure. Apparatus 10 further comprises a loading device or hopper 14 which provides internal access to housing structure 12 through which a batch of sludge 60 may be fed. Hopper 14 preferably includes a feed conveyor drive 15 and associated drive cover 15' for driving a feed conveyor in the bottom of hopper 14 (not shown). The feed conveyor 15 within hopper 14 may be any conventional type, such as a small auger, for conveying sludge 60 placed in hopper 14.

Conveyor means A are provided substantially internal to housing structure 12 for receiving sludge 60 from hopper 14. As depicted particularly in FIGS. 8 and 9, conveyor means A comprises essentially a continuous closed loop circulating path 11 for circulating sludge 60 within housing structure 12. Preferably, conveyor means A comprises at least one auger disposed within an auger housing, for example auger 34 and housing 36 shown in FIG. 3. In a preferred embodiment, conveyor means A comprises a plurality of augers configured in a loop 11, with each auger being disposed within an auger housing, as shown in FIGS. 3, 4, 8, and 9.

An example of apparatus 10 utilizing a plurality of augers is shown in the figures in general and comprises four such augers. Disposed adjacent to hopper 14 is a first auger 16 disposed within a first auger housing 17 for conveying sludge 60 received from hopper 14 essentially along the length of auger 16. First auger 16 is driven by a first auger drive unit 18, which has a drive unit cover 20. Drive unit 18 may comprise any conventional type of drive unit, such as a mechanical, electrical, or hydraulic motor. Further, a single such drive unit may be utilized to drive all of the augers, or an individual drive unit may be provided for each auger, as illustrated in the figures.

Figure 9:
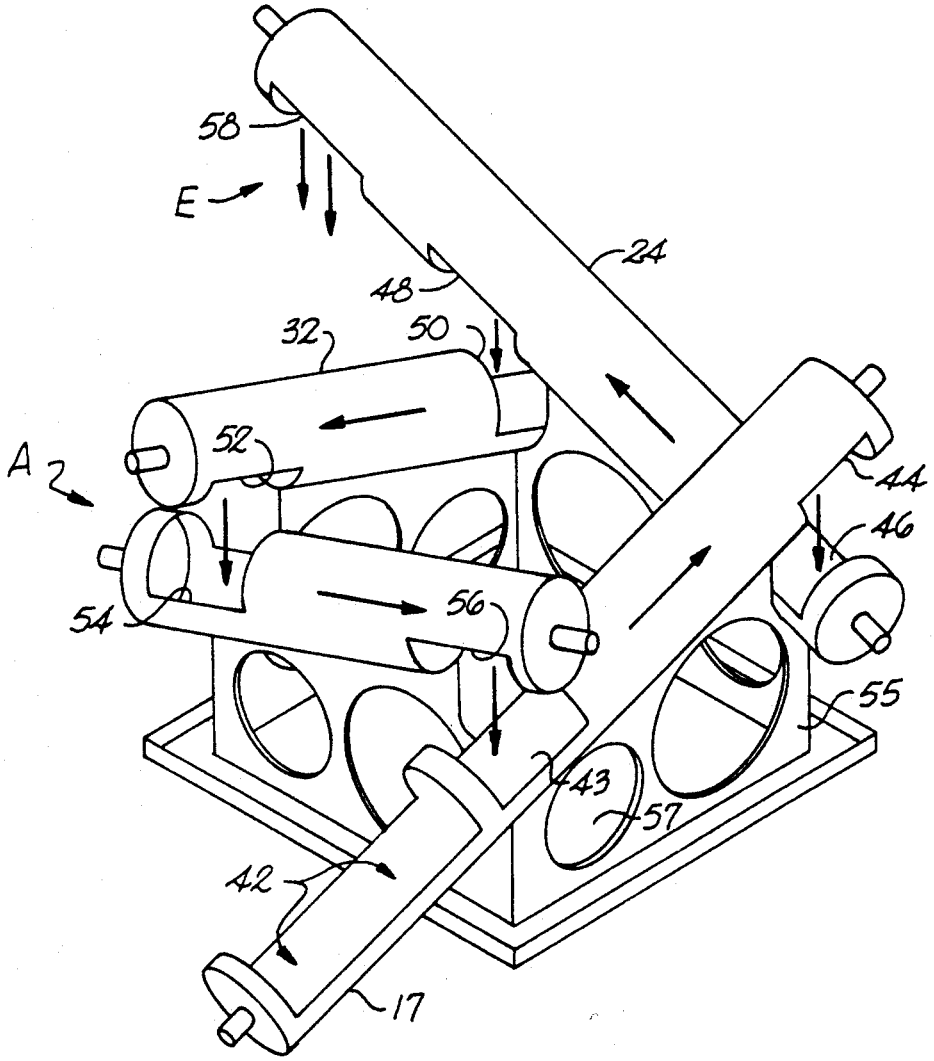
FIG. 9 is a partial component view illustrating the auger housing associated with the auger arrangement shown in FIG. 8.

Referring to FIG. 9 in particular, first auger 16 disposed within auger housing 17 receives a batch of sludge 60 through opening 42 from hopper 14. First auger 16 conveys the wet sludge through housing 17 preferably along the entire length thereof. The first auger conveys the wet sludge 60 to a point above and over second auger housing 24 within which is disposed second auger 22 driven by a second drive unit 26 which has a cover 28. Sludge 60 conveyed by first auger 16 is discharged through discharge opening 44 in first auger housing 17 and received by transfer opening 46 in second auger housing 24. Likewise, second auger 22 conveys sludge 60 to a point above and over third auger 30 disposed in its respective auger housing 32. Auger housing 24 has a discharge opening 48 for selectively discharging wet sludge into transfer opening 50 in third auger housing 32. Auger housing 32 has disposed therein third auger 30 which receives and conveys sludge 60 to a point which overlies fourth auger 34. Auger 34 is disposed in fourth auger housing 36 and is driven by fourth drive unit 38 disposed within cover 40.

Figure 8:
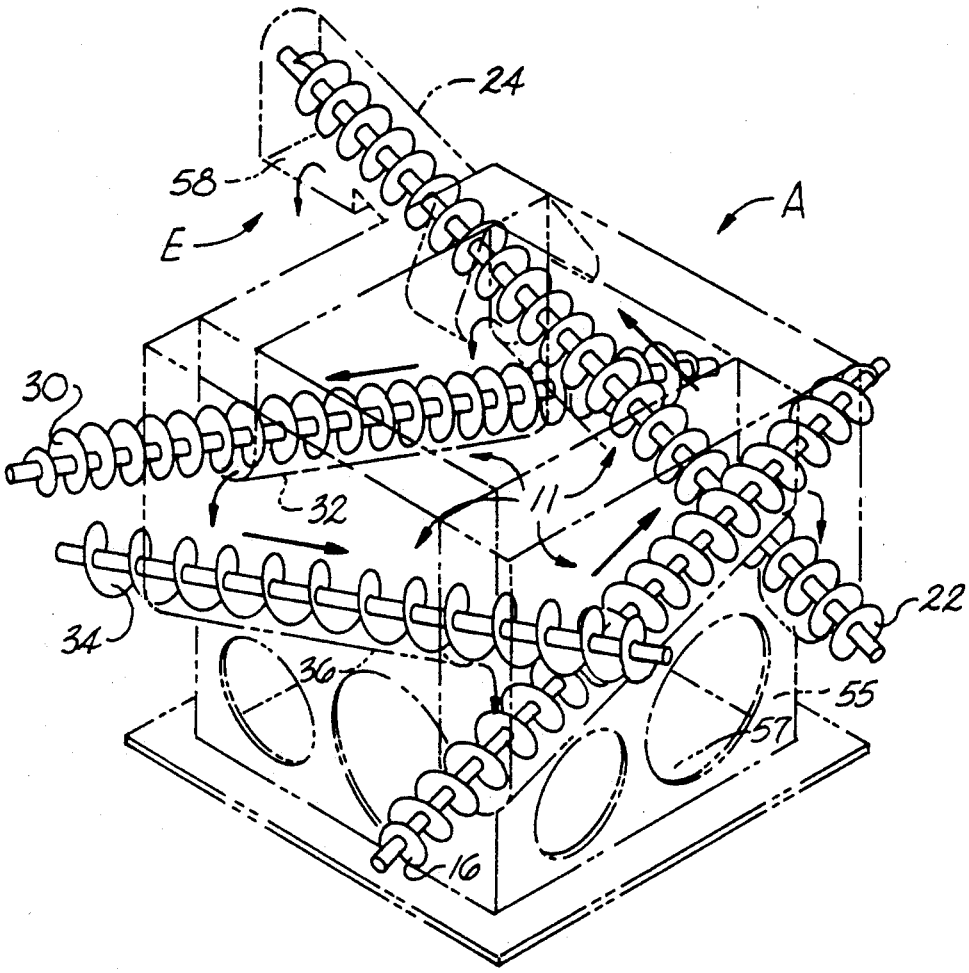
FIG. 8 is a partial component view particularly illustrating the arrangement of augers according to the invention.

It should be understood that the arrangement of augers illustrated in FIGS. 8 and 9 is but a preferred embodiment of conveyor means A. Any number of augers may be utilized to form the recirculating loop for the sludge material. For example, the augers may be disposed essentially one above the other with one such auger defining a conveying path between the uppermost and bottommost augers.

Preferably the configuration of augers is supported upon a frame structure 55, particularly shown in FIGS. 8 and 9. Frame structure 55 preferably includes a plurality of openings 57 therethrough so that air may circulate freely within housing structure 12 between and around the auger housings.

When second housing discharge opening 48 is opened, wet sludge 60 is transferred to third conveyor housing 32 through transfer opening 50. The wet sludge conveyed by third auger 30 is discharged through discharge opening 52 into a transfer opening 54 in fourth auger housing 36. Sludge 60 is then conveyed to a discharge opening 56 in fourth auger housing 54 from which it is transferred to transfer opening 43 in first auger housing 17, and so forth. The wet sludge continues to circulate through the loop of augers until it has dried to a predetermined moisture content.

It should be understood that while conveyor means A according to the invention has been illustrated and described as a system of augers, this is but one preferred embodiment of the invention. Any type of conveyor can be used for circulating the sludge, such as a conveyor belt or the like. However, an auger is preferred in that it tends to mix the sludge with air as it conveys the sludge therealong.

Apparatus 10 according to the invention further includes means C for heating and circulating housing drying air around conveyor means A within housing structure 12. Further, means D are provided for heating and drawing sludge drying air through conveyor means A so that the heated air directly contacts and dries the sludge as it circulates within conveyor means A. Means C and D define two separate airstream systems 13 and 17 depicted diagrammatically in FIG. 2 for heated air through apparatus 10.

Figure 2:
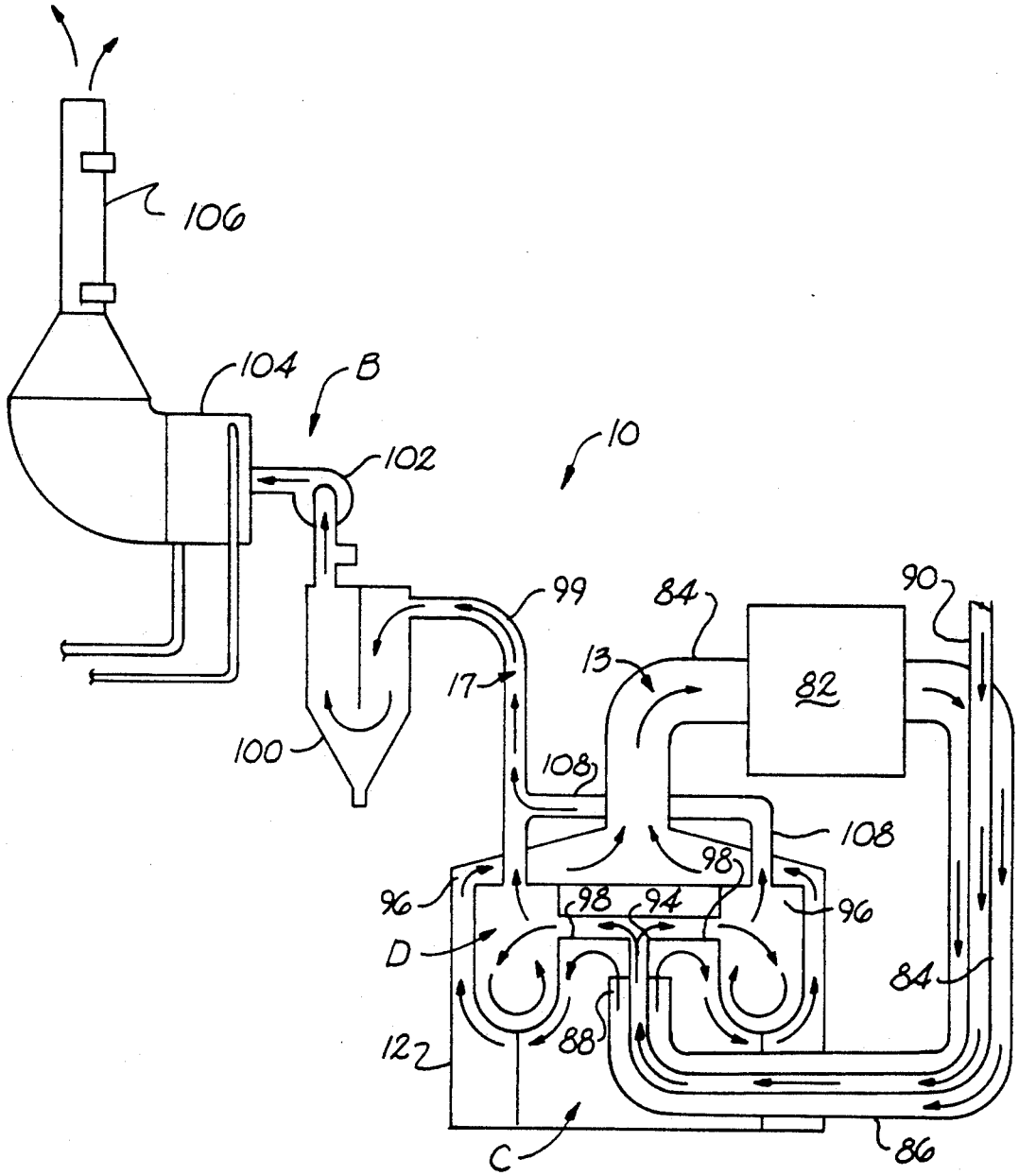
FIG. 2 is a diagrammatic view of the air passages through the apparatus of the invention illustrated in FIG. 1.
Figure 3:
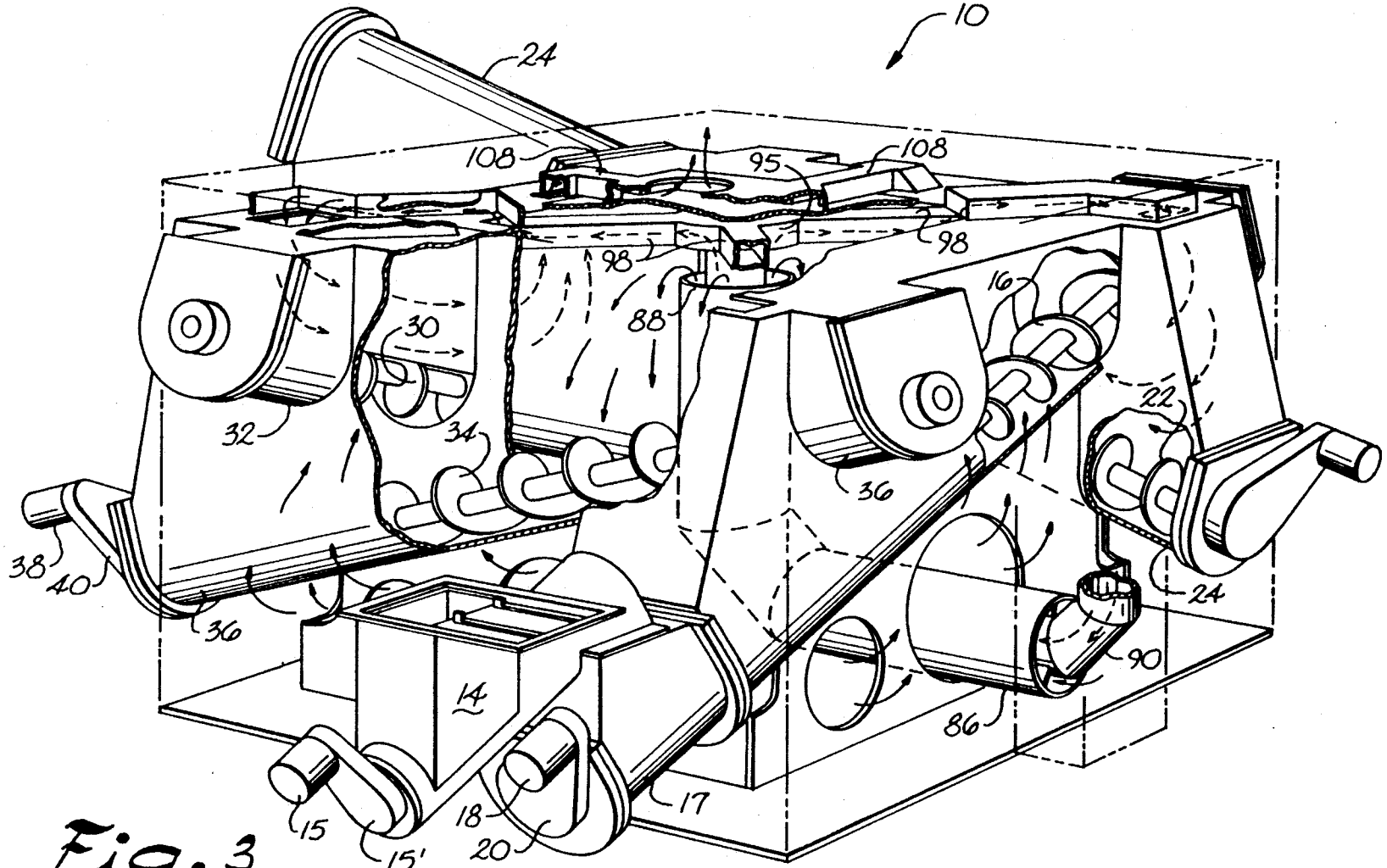
FIG. 3 is a perspective view of the apparatus of the invention similar to that shown in FIG. 1 but, with further parts shown in partial cut-away to illustrate the conveyor means.
Figure 4:
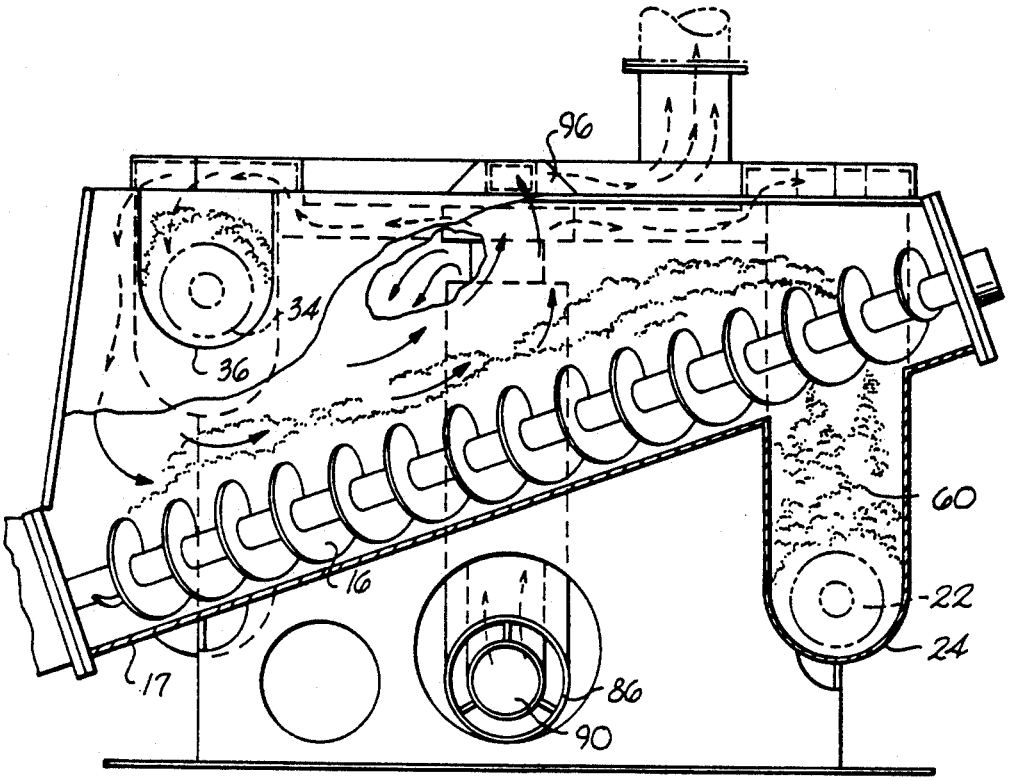
FIG. 4 is a side view of the apparatus with portions shown in cut-away illustrating the dryer conveyors in particular.
Figure 5:
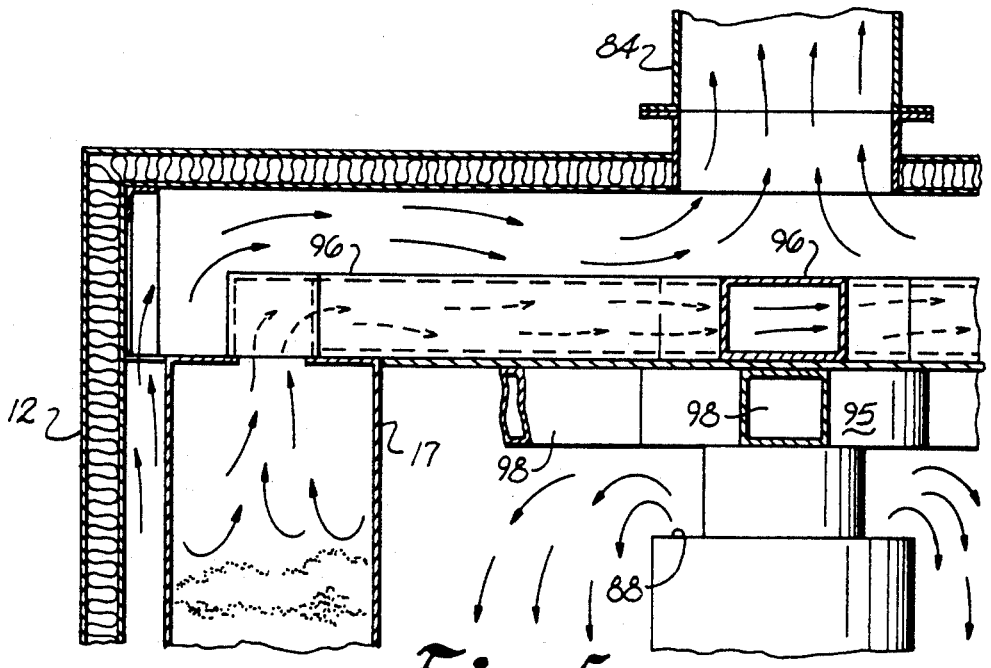
FIG. 5 is a detailed partial view of the air piping system according to the invention, with air flow therethrough being indicated by the solid and dashed pointed lines.

Referring primarily to FIGS. 1 and 2, means C includes a first air stream system 13 defining a flow path essentially within the overall housing structure 12. Air is drawn out of structure 12 through duct 84 to heating element 82 which heats the air received from housing 12 and pushes it through the other side of duct 84 to a pipe 86 entering structure 12. Pipe 86 carries the heated air back into the internal volume of housing structure 12 where it is circulated around the outside of the four auger housings 17, 24, 32, and 36. In this manner, the heated air removes moisture build-up within the internal volume of structure 12 and also heats the sludge material within the auger housings by conduction through the auger housings.

Heating element 82 may comprise any conventional heating device, such as a heat exchanger or strip heater. A blower or other similar device (not shown) is preferably included for drawing air through housing structure 12 around conveyor means A and through heating element 82. The heated air continues to circulate through housing 12 and heating element 82 and about the outside of conveyor means A without coming into contact with sludge 60 itself.

Preferably, a filter device 83 is provided for allowing a controlled amount of fresh air to be introduced into the heated housing drying air, as illustrated in FIG. 1. In this embodiment, the blower or like device for drawing air through housing 12 may be incorporated within heating element 82.

Apparatus 10 also includes means D for heating and drawing sludge drying air through conveyor means A. Referring to FIGS. 1 through 5 in particular, a second air stream system 17 defines a path for air drawn from atmosphere through an air intake pipe 90. Preferably, duct 90 runs for at least a portion of the length thereof internal to duct 84, as shown particularly in FIGS. 1 and 2. In this manner, the heated air from heating device 82 heats the air drawn through duct 90 through conduction.

Intake pipe 90 extends through duct 84 and 86 and has an outlet 94 which dumps now heated air into an intake distribution chamber 95. Chamber 95 distributes the sludge drying air into each of the auger housings through a distribution duct 98, shown particularly in FIGS. 3 and 5. The amount of sludge drying air admitted into intake pipe 90 is controlled by a damper 92, or like device. Distribution ducts 98 open into the auger housings so that heated air enters the interior of the auger housings to dry the sludge being circulated therethrough and to remove dust and other airborne particles from within the auger housings.

The drying air from within the auger housings is exhausted through outlet ducts 108 and outlet plenums 96 which open into each of the auger housings. This flow path is shown diagrammatically in FIG. 2 and generally in FIGS. 1 through 5. This exhaustive air exits through outlet pipe 99 to filtering means for cleaning the air prior to it being exhausted to atmosphere. The filtering means preferably comprises a cyclone separator 100 for removing dust and other airborne particles from the exhausted air stream. The exhausted air is then directed to wet scrubber 104 where it is cleaned and exhausted into the atmosphere from exhaust pipe 106.

Apparatus 10 further comprises means B for drawing a vacuum of predetermined magnitude within conveyor means A. Means B may preferably include an exhaust fan 102, as illustrated in FIG. 2. It is preferred to draw a relatively high vacuum within the auger housings so as to efficiently dry the sludge at a lesser temperature. For instance, typical methods for drying sludge require that the temperature of the sludge be raised to approximately 850 to 1100° F. In an embodiment of the present invention sized to dry 17 cubic feet of sludge in a batch, the sludge can be sufficiently dried at a temperature of 400° if a vacuum of two to three inches is drawn in the system. In this embodiment, the augers are each approximately 16 inches in diameter and the feeding conveyor or auger within hopper 14 is approximately 12 inches in diameter.

Figure 6:
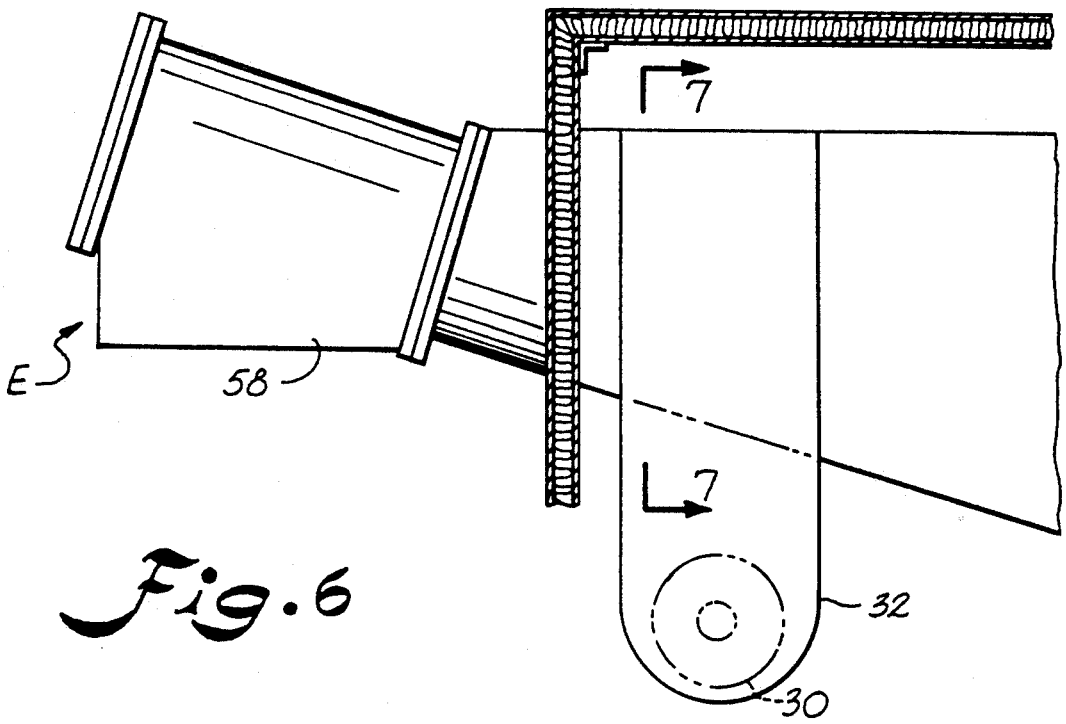
FIG. 6 is a partial view of the apparatus of the invention taken along line 6—6 of FIG. 1.
Figure 7:
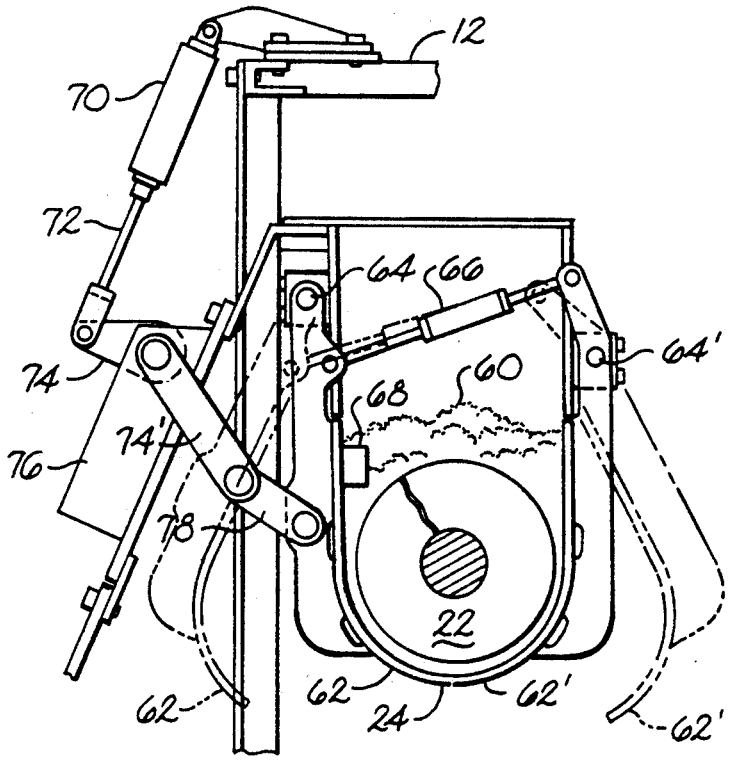
FIG. 7 is a sectional view of the portion of the apparatus of the invention taken along lines 7—7 of FIG. 6.

An embodiment of means E for discharging the sludge from conveyor means A is shown generally in FIGS. 6, 7, and 9. In one embodiment, as shown in FIG. 9, second auger housing 24 has an unloading opening 58 for selectively unloading the dried sludge. Opening 58 is normally closed by a pair of clam shell doors 62 and 62' as seen in FIG. 7. Doors 62 and 62' are pivotally mounted on the auger housing by means of pivots 64 and 64'. The upper ends of the doors 62 and 62' are connected by an adjusting rod 66. It will be noted that one end of rod 66 is pivotally connected to a clam shell door 62 below pivot 64, whereas the other end of adjusting rod 66 is pivotally connected to clam shell door 62 at a point above pivot 64'. The length of adjusting rod 66 is adjustable so as to provide for an adjustment in the contact between doors 62 and 62' so as to close opening 58 in conveyor housing 24. During normal operations, doors 62 and 62' are maintained in the closed position while the sludge circulates through the apparatus.

Apparatus 10 also preferably comprises a sensing device 68 such as a humidistat, for sensing the moisture content of the sludge being treated. Preferably, device 68 includes an external indication of the moisture content of the sludge. Preferably, device 68 signals a control means (not shown) which closes discharge opening 48 in housing 24 while at the same time activating fluid operated piston 70 to draw in piston rod 72. Rod 72, through crank 74 which pivots on lock 76, causes arm 34' to draw element 78 so as to open door 62 and 62'. In this manner, the dried sludge is discharged from the auger housing. At the same time, a door (not shown) is operated to close discharge opening 48 in second auger housing 24 so that auger 22 continues to convey sludge 60 to unloading opening 58. Thus, the dried sludge is automatically discharged into a suitable container (not shown).

It will be apparent to those skilled in the art that various modifications and variations can be made in the apparatus and method of the present invention without departing from the scope or spirit of the invention. For example, the conveyor means according to the invention can comprise any suitable device for moving the sludge through the apparatus. Thus, it is intended that the present invention cover the modifications and variations of this invention provided they come within the scope of the appended claims and their equivalents.

What is claimed is:

1. An apparatus for drying wet sludge, comprising:

a housing structure;

a hopper providing internal access to said housing structure for receiving a batch of sludge;

conveyor means substantially internal to said housing structure for receiving the sludge from said hopper, said conveyor means defining an essentially closed loop circulating path for the sludge within said housing structure;

means for drawing a vacuum of predetermined magnitude within said conveyor means;

means for heating and circulating housing drying air around said conveyor means within said housing structure;

means for heating and drawing sludge drying air through said conveyor means so that the sludge drying air directly contacts and dries the sludge as it circulates within said closed loop; and means for discharging the sludge from said conveyor means once the sludge has been dried to a predetermined moisture content.

2. The apparatus as in claim 1, wherein said hopper further comprises a feed convey drive for feeding the sludge to said conveyor means.

3. The apparatus as in claim 1, wherein said conveyor means comprises at least one auger disposed within an auger housing, said housing having openings for receiving and discharging the sludge.

4. The apparatus as in claim 1, wherein said conveyor means comprises a plurality of augers operatively configured in loop, each of said augers being disposed within an auger housing, at least one of said augers having an opening for receiving the sludge, and at least one of said augers having an opening for discharging the sludge from said loop.

5. The apparatus as in claim 4, comprising four augers within auger housings defining essentially a rectangular closed loop for circulating the sludge therethrough.

6. The apparatus as in claim 1, further comprising a sensing device for sensing the moisture content of sludge within said conveyor means.

7. The apparatus as in claim 1, further comprising filtering means for cleaning the sludge drying air drawn through said conveyor means prior to the air being exhausted to atmosphere.

8. The apparatus as in claim 1, wherein said means for heating and drawing sludge drying air comprises a damper for drawing a controlled amount of fresh air into said conveyor means, said fresh air being heated by said means for heating and circulating housing drying air.

9. The apparatus as in claim 1, wherein said means for drawing a vacuum within said conveyor means comprises a vacuum fan disposed operatively in-line with said means for heating and drawing sludge drying air.

10. The apparatus as in claim 1, wherein said means for heating and circulating housing drying air comprises a blower for circulating air through said housing structure, and a heating device for heating the air circulated through said housing structure and around said conveyor means.

11. A sludge drying apparatus, comprising:

a loading device for receiving sludge;

a plurality of driven augers disposed relative each other so as to form a continuous operative loop with each said auger receiving sludge from another said auger and depositing sludge into yet another said auger, at least one said auger receiving sludge from said loading device;

at least one auger housing surrounding said augers;

means for drawing a first heated air stream through said auger housing, said first heated air stream directly contacting the sludge conveyed through said augers;

means for drawing a second heated air stream through said apparatus around said auger housing;

means for determining the moisture content of the sludge within said augers; and means for discharging said sludge from said continuous loop of augers once the sludge has dried sufficiently.

12. The apparatus as in claim 11, wherein said first heated air stream is heated by said second heated air stream, said means for drawing a second heated air stream comprising a heating element for heating said second heated air stream.

13. A batch sludge drying system, comprising:

a housing structure with an attached hopper for receiving a batch of sludge;

a first auger and associated auger housing within said housing structure receiving the sludge batch from said hopper;

a second auger and associated auger housing in operative communication with said first auger and associated auger housing for receiving the sludge batch therefrom;

a third auger and associated auger housing in operative communication with said second auger and associated auger housing for receiving the sludge batch therefrom;

a fourth auger and associated auger housing in operative communication with said third auger and associated 15 auger housing for receiving the sludge batch therefrom, said fourth auger and associated auger housing also in operative communication with said first auger and associated auger housing for discharging the sludge batch thereto;

a sensing device for indicating the moisture content of the sludge within said augers at a predetermined location therein;

a first heated airstream system defining a path for heated drying air through said housing structure and said augers and associated auger housings, whereby heated air comes into direct contact with the sludge within said augers, said first heated air stream system including exhaust piping for exhausting the heated air from said system;

a vacuum fan operatively disposed in-line in said first heated airstream system for drawing a vacuum within said auger housings;

an air cleaning device operatively disposed in-line in said first heated airstream piping system for cleaning the heated air drawn through said auger housings;

a second heated air stream system defining a circulating airstream path through said housing structure and around said auger housings, including a heating element for heating air circulated therethrough, whereby at least a portion of said first heated airstream system is in direct contact with air heated by said heating element so as to heat air with said first heated airstream system; and an outlet extending from one of said auger housings through said housing structure for discharging the sludge from said system.

14. A method for drying wet sludge, comprising:

feeding a batch of wet sludge into a multi-pass dryer conveyor means;

circulating the wet sludge through the dryer conveyor means;

drawing a vacuum within the dryer conveyor means;

drawing heated sludge drying air through said conveyor means and sludge as the sludge circulates through the conveyor means;

drawing heated drying air around the conveyor means separate from the sludge drying air to remove moisture from the space around the conveyor means;

sensing the moisture content of sludge circulated through the conveyor means;

cleaning the sludge drying air before exhausting to atmosphere; and removing the sludge from the conveyor means when the sludge has dried to a sufficient moisture content.

15. The method as in claim 14, further comprising moving the sludge through the conveyor means with a series of augers.

16. The method as in claim 14, further comprising heating the air drawn around the conveyor means with a heating element, the air heated by the heating element in turn heating the air drawn through the conveyor means.

17. The method as in claim 14, further comprising heating the air drawn through the conveyor means with a heating element, the air heated by the heating element in turn heating the air drawn around the conveyor means.

* * * * *